US008268029B2

(12) United States Patent
Yoo

(10) Patent No.: US 8,268,029 B2
(45) Date of Patent: Sep. 18, 2012

(54) CYCLONE DUST-COLLECTING APPARATUS

(75) Inventor: Dong-Hun Yoo, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 532 days.

(21) Appl. No.: 12/454,341

(22) Filed: May 15, 2009

(65) Prior Publication Data

US 2009/0305862 A1 Dec. 10, 2009

(30) Foreign Application Priority Data

Jun. 10, 2008 (KR) ..... 10-2008-0054336

(51) Int. Cl.
*B04C 9/00* (2006.01)
*A47L 9/16* (2006.01)

(52) U.S. Cl. ..... 55/337; 55/357; 55/410; 55/459.1; 55/DIG. 3; 15/352; 15/353

(58) Field of Classification Search ..... 15/352, 15/353; 55/345, 346, 410, 459.1, DIG. 3, 55/337, 357

See application file for complete search history.

(56) References Cited

U.S. PATENT DOCUMENTS 3,877,902 A 4/1975 Eriksson et al.

FOREIGN PATENT DOCUMENTS

GB 2400309 10/2004

OTHER PUBLICATIONS

Combined Search and Examination Report for corresponding Great Britain Patent Application No. GB0608817.0 dated Jul. 31, 2009.

*Primary Examiner* — David A Reifsnyder

(74) *Attorney, Agent, or Firm* — Ohlandt, Greeley, Ruggiero & Perle, LLP

(57) ABSTRACT

A cyclone dust-collecting apparatus includes a body unit, a top portion of which is detachably engaged with a cover unit; a cyclone unit disposed inside the body; and a filter unit detachably disposed above the cyclone unit, wherein air flowing into the body unit is guided from the cyclone unit upward to the filter unit, and is discharged downward via the filter unit.

17 Claims, 5 Drawing Sheets

CYCLONE DUST-COLLECTING APPARATUS

CROSS-REFERENCE TO RELATED APPLICATION

This application claims the benefit under 35 U.S.C. §119 from Korean Patent Application No. 10-2008-0054336, filed on Jun. 10, 2008, in the Korean Intellectual Property Office, and the entire disclosure of which is incorporated herein by reference.

BACKGROUND OF THE INVENTION

1. Field of the Invention

The present disclosure relates to a cyclone dust-collecting apparatus, and more particularly, to a cyclone dust-collecting apparatus to separate dust from air drawn into a cleaner main body through a suction port body, collect the separated dust, and discharge air from which dust has been separated from the cleaner main body.

2. Description of the Related Art

A vacuum cleaner generates a suction force using a suction motor mounted in a cleaner main body, and draws in dust or dirt along with air from a surface being cleaned through a suction nozzle using the suction force. Dust or dirt is removed from the air, while the air containing dust or dirt passes through a cyclone dust-collector mounted in the cleaner main body, and the air from which the dust or dirt has been removed is discharged from the cyclone dust-collector.

Such a conventional cyclone dust-collector includes a cyclone unit and a filter unit, which are fixed thereinside in a complicated structure. Accordingly, in order to maintain and repair the cyclone unit and filter unit, a plurality of units inside the cyclone dust-collector need to be separated, which causes user inconvenience. Additionally, it may be difficult for users other than engineers to disassemble a conventional cyclone dust-collector.

Furthermore, a long airflow path is formed due to the complicated internal structure of a conventional cyclone dust-collector, so pressure loss may occur inside such a cyclone dust-collector, thereby weakening the suction force.

SUMMARY OF THE INVENTION

The present disclosure has been developed in order to solve the above described and other problems in the related art. Accordingly, an aspect of the present disclosure is to provide a cyclone dust-collecting apparatus, which enables a user to easily separate a cyclone unit and a filter unit, and to maintain and repair the cyclone unit and filter unit.

Another aspect of the present disclosure is to provide a cyclone dust-collecting apparatus in which an airflow path has a minimal length so that pressure loss occurring thereinside can be reduced.

The above aspect is achieved by providing a cyclone dust-collecting apparatus including a body unit, a top portion of which is detachably engaged with a cover unit; a cyclone unit disposed inside the body; and a filter unit detachably disposed above the cyclone unit, wherein air flowing into the body unit is guided from the cyclone unit upward to the filter unit, and is discharged downward via the filter unit.

The cyclone unit may be disposed perpendicular to an axis of the body unit. Air may be drawn into the cyclone unit in the same direction as a direction in which the cyclone unit is disposed, and air may be discharged from the cyclone unit in a direction perpendicular to the cyclone unit. The cyclone unit may include a cylindrical housing in which dust is centrifugally separated from air; a discharge pipe disposed inside the cylindrical housing and coaxially with the cylindrical housing; and a guide pipe extending from one side of the discharge pipe and penetrating the filter unit, the guide pipe being perpendicular to and in fluid communication with the discharge pipe.

The cover unit may include a handle extending upward therefrom, and may be disposed to cover the filter unit. Accordingly, it is possible for a user to easily detach the cover unit from the body unit using the handle.

The filter unit may include a filter; and a filter body detachably disposed in an upper portion of the body unit so that the filter is spaced apart by a predetermined distance from an upper portion of the cyclone unit. The filter body may include a support rib to support the filter so that air passes downward through the filter. The filter body may further include a protruding portion through which the guide pipe to discharge air from the cyclone unit penetrates, and a grip portion extending upward from the protruding portion to separate the filter body from the body unit.

The filter body may further include a sealing member enclosing an outer circumference of an upper portion of the filter body, to maintain an airtight state between the filter body and the cover unit.

The cylindrical housing may include a dust-collecting chamber disposed below the cyclone unit to collect dust.

BRIEF DESCRIPTION OF THE SEVERAL VIEWS OF THE DRAWINGS

These and/or other aspects and advantages of the disclosure will become apparent and more readily appreciated from the following description of the embodiments, and accompanying drawings in which.

Throughout the drawings, like reference numerals will be understood to refer to like parts, components and structures.

DETAILED DESCRIPTION OF THE INVENTION

Hereinafter, a cyclone dust-collecting apparatus according to an exemplary embodiment of the present disclosure will now be described in greater detail with reference to the accompanying drawing figures.

Figure 1:
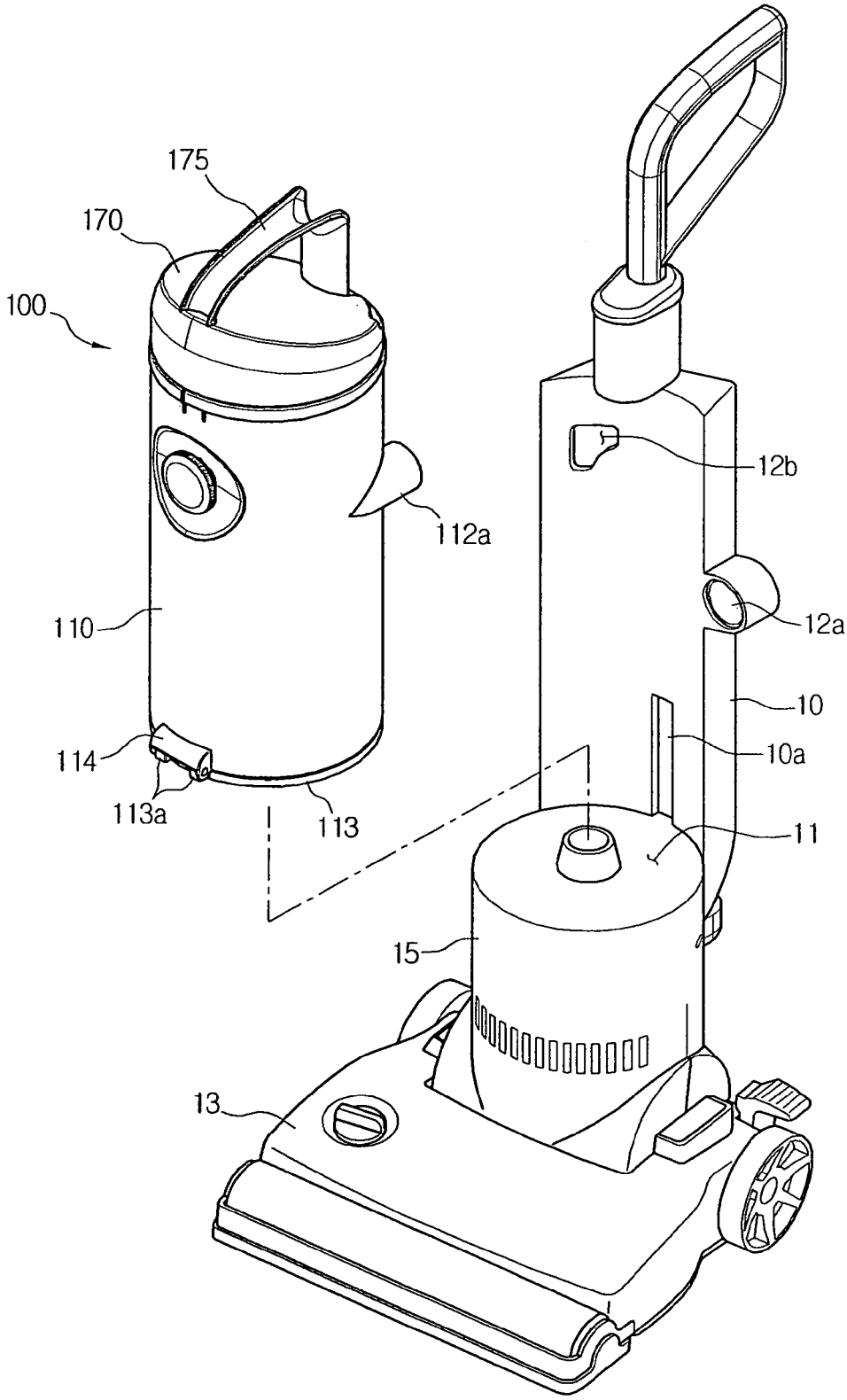
FIG. 1 is a perspective view of a cyclone dust-collecting apparatus separated from a cleaner main body according to an exemplary embodiment of the present disclosure.
Figure 2:
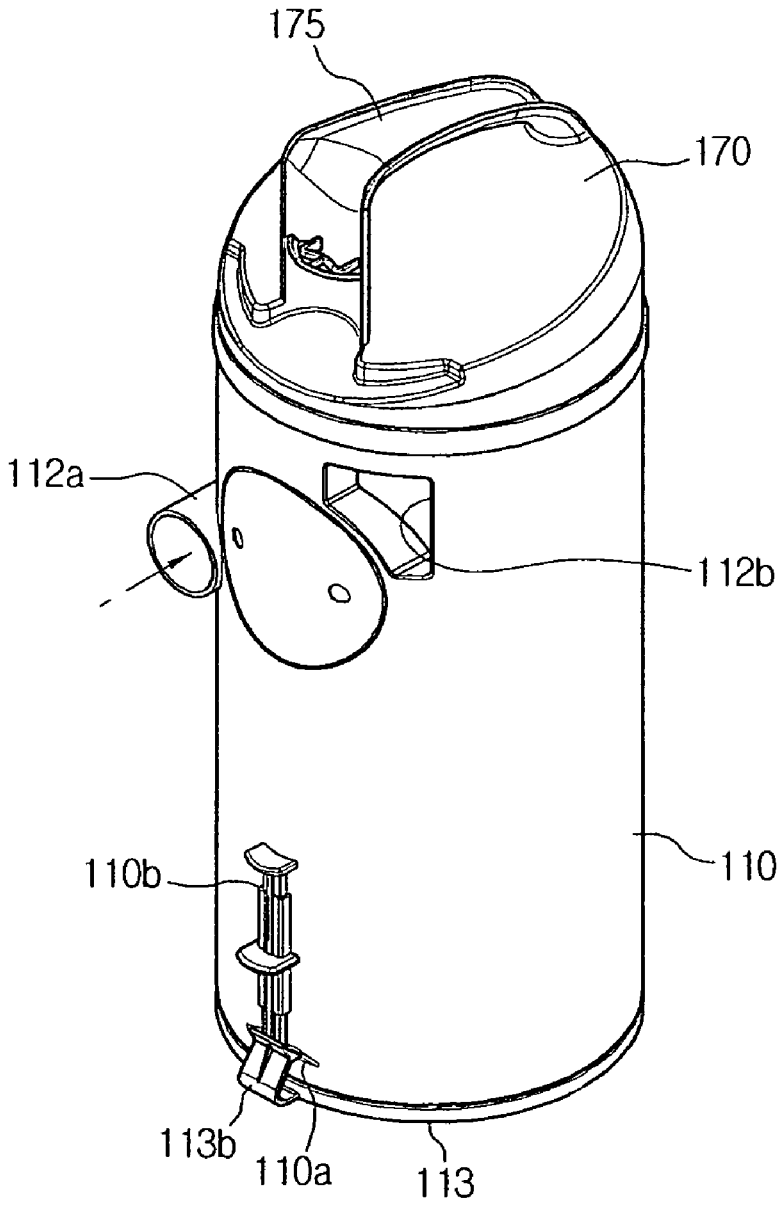
FIG. 2 is a rear perspective view of the cyclone dust-collecting apparatus of FIG. 1.

Referring to FIGS. 1 and 2, the cyclone dust-collecting apparatus 100 is detachably mounted on a mounting unit 11 of a cleaner main body 10. The cleaner main body 10 includes a main discharge port 12*a* to discharge dust-laden air drawn through a suction port body 13 into the cyclone dust-collecting apparatus 100, and a main inlet 12*b* to guide air discharged from the cyclone dust-collecting apparatus 100 towards a motor chamber 15.

The cyclone dust-collecting apparatus 100 includes a body unit 110, a cyclone unit 130 (shown in FIG. 5), a filter unit 150, and a cover unit 170.

The body unit 110 is configured in a substantially cylindrical shape, and includes the cyclone unit 130 disposed thereinside. The body unit 110 also includes a dust-collecting chamber 111 (FIG. 5) disposed below the cyclone unit 130 to collect dust discharged from the cyclone unit 130.

Additionally, the body unit 110 includes an inlet 112*a*, which protrudes from a rear portion thereof and fluidly communicates with one side of the cyclone unit 130, and a discharge port 112*b* to discharge air from the cyclone dust-collecting apparatus 100 through the cover unit 170. If the cyclone dust-collecting apparatus 100 is mounted on the mounting unit 11 of the cleaner main body 10, the inlet 112*a* and discharge port 112*b* of the body unit 110 fluidly communicate with the main discharge port 12*a* and main inlet 12*b* of the cleaner main body 10, respectively.

Furthermore, the body unit 110 includes a dust door 113 on the bottom thereof.

The dust door 113 includes a pair of hinge protrusions 113*a* formed on one side thereof, and a hook 113*b* formed on the side opposite the pair of hinge protrusions 113*a*. The pair of hinge protrusions 113*a* are hinged to a hinge 114 formed on a front bottom end of the body unit 110, so the bottom portion of the body unit 110, namely the dust door 113, may be opened. Additionally, the hook 113*b* is engaged into a locking slit 110*a* formed on a rear bottom end of the body unit 110, so the bottom portion of the body unit 110, namely the dust door 113, may be closed while the hook 113*b* is engaged in the locking slit 110*a*.

The body unit 110 includes an unlocking rod 110*b*, which is formed on the rear portion thereof. The unlocking rod 110*b* is able to slide lengthwise along the body unit 110, so the hook 113*b* may be disengaged from the locking slit 110*a* by the sliding motion of the unlocking rod 110*b*. If the cyclone dust-collecting apparatus 100 is mounted on the mounting unit 11, the unlocking rod 110*b* and hook 113*b* are inserted into a groove 10*a* (see FIG. 1) formed on the cleaner main body 10.

Figure 5:
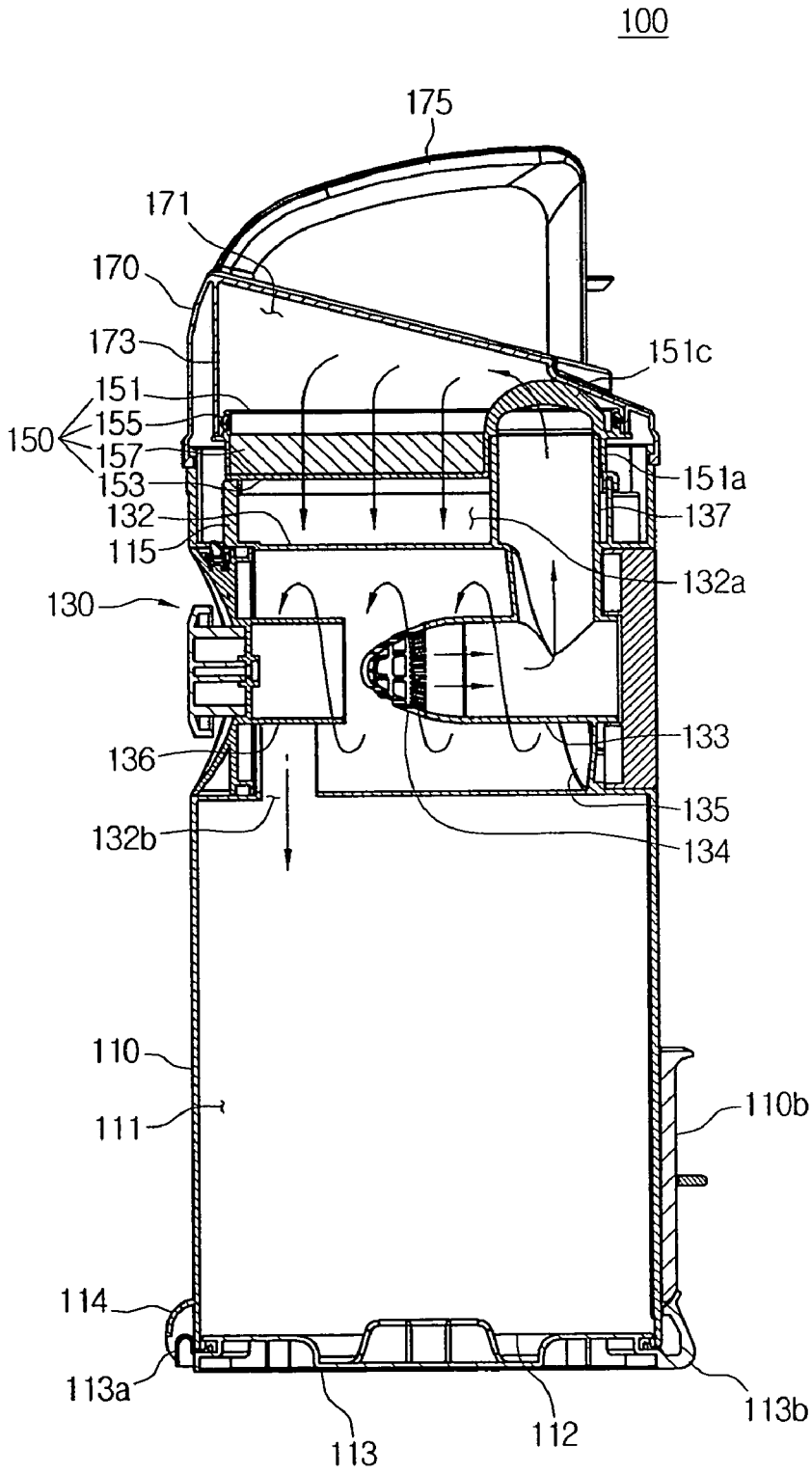
FIG. 5 is a sectional view of the cyclone dust-collecting apparatus of FIG. 1, taken along line V-V in FIG. 4.

The cyclone unit 130 includes a cylindrical housing 132, a discharge pipe 133, a grill member 134, a rotating guide 135, a stabilizer 136 and a guide pipe 137, as shown in FIG. 5.

The cylindrical housing 132 is configured substantially perpendicular to the vertical axis of the body unit 110, and fluidly communicates with the inlet 112*a* of the body unit 110. One side of the cylindrical housing 132 extends from an inner wall of the body unit 110, and the opposite side is spaced apart by a predetermined gap from the inner wall of the body unit 110, so the predetermined gap forms a dust passage 132*b* to guide dust centrifugally discharged from the cylindrical housing 132 towards the dust-collecting chamber 111. Additionally, the cylindrical housing 132 includes a second airflow path 132*a* formed thereabove to guide air passing through a filter 157 towards the discharge port 112*b* of the body unit 110.

The discharge pipe 133 is disposed substantially coaxially with the cylindrical housing 132 and inside the center of the cylindrical housing 132. The discharge pipe 133 discharges air, from which dust has been separated in the cylindrical housing 132, from the cylindrical housing 132.

The grill member 134 is connected to a leading end of the discharge pipe 133 and prevents relatively large dust from flowing into the discharge pipe 133.

The rotating guide 135 is configured in a spiral shape between the cylindrical housing 132 and the discharge pipe 133. The rotating guide 135 causes dust-laden air flowing into the body unit 110 via the inlet 112*a* at a predetermined flow rate by the suction force exerted by a suction motor (not illustrated) in the motor chamber 15 to rotate inside the cylindrical housing 132, while guiding the dust-laden air towards the dust passage 132*b*, so that dust can be effectively separated from the dust-laden air using the centrifugal force generated by rotation of the dust-laden air. In this manner, cyclone unit 130 is configured to rotate the dust-laden air within cylindrical housing 132 about a generally horizontal axis that is substantially perpendicular to the vertical axis of the body unit 110.

The stabilizer 136 having a pipe shape protrudes from the inner wall of the body unit 110 and is aligned coaxially with the discharge pipe 133. The stabilizer 136 allows an air current which is made to rotate by the rotating guide 135 to continue to rotate after passing through the leading end of the discharge pipe 133, so that dust separated from the air current can flow towards the dust passage 132*b* stably while rotating.

The guide pipe 137 extends from one side of the discharge pipe 133, and is perpendicular to and in fluid communication with the discharge pipe 133, in order to guide air from which dust has been separated first by the cyclone unit 130 towards the filter unit 150.

Figure 3:
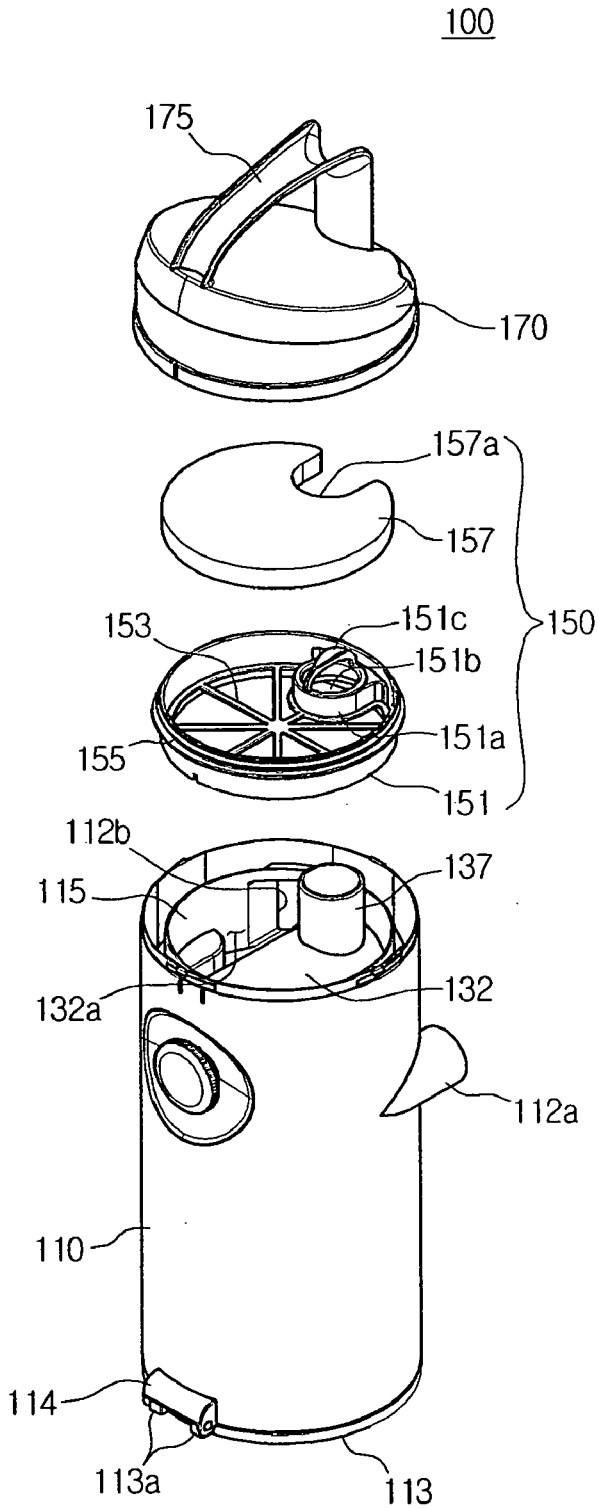
FIG. 3 is an exploded perspective view of the cyclone dust-collecting apparatus of FIG. 1.
Figure 4:
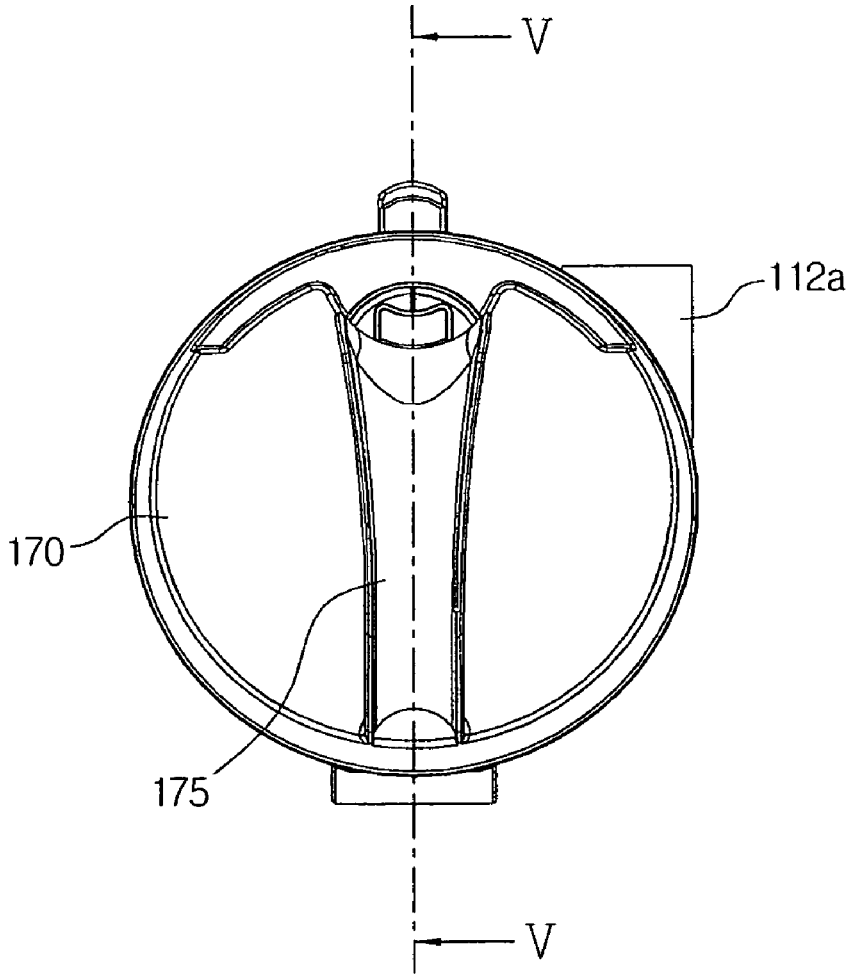
FIG. 4 is a top view of the cyclone dust-collecting apparatus of FIG. 1.

Referring to FIG. 3, the filter unit 150 is disposed above the cylindrical housing 132 to filter relatively fine dust from the air from which dust has been separated first by the cyclone unit 130. The filter unit 150 includes a filter body 151, a plurality of support ribs 153 and a filter 157.

The filter body 151 is detachably disposed in an extension wall 115 formed inside the body unit 110, so that the filter 157 is spaced apart by a predetermined distance from an upper portion of the cylindrical housing 132. The plurality of support ribs 153 hold the filter 157 inserted into the filter body 151. The plurality of support ribs 153 having a low thickness are spaced equally radiating from the center of the filter body 151, so that air flowing into the filter 157 can be discharged downward from the filter 157.

Additionally, the filter body 151 includes a protruding portion 151*a* having a cylindrical shape, which extends from an inner wall thereof to receive the guide pipe 137 of the cyclone unit 130. Furthermore, a grip portion 151*c* extends upward from the protruding portion 151*a*, so that a user can easily separate the filter body 151 from the body unit 110 by gripping the grip portion 151*c*.

The filter body 151 also includes a sealing member 155 enclosing an outer circumference of an upper portion of the filter body 151 in order to maintain an airtight state between the filter body 151 and the cover unit 170.

The filter 157 may be formed of, for example, a sponge. The filter 157 has a recess 157*a* corresponding to the protruding portion 151*a* to prevent the protruding portion 151*a* from interfering with the filter 157 when the filter 157 is inserted into the filter body 151.

The cover unit 170 is connected to an opened top portion of the body unit 110 to cover the filter unit 150 inside the body unit 110. The cover unit 170 includes a cylindrical protrusion 173 extending from the inside thereof to provide a first airflow path 171. A bottom portion of the cylindrical protrusion 173 is connected to the top portion of the filter body 151, and an airtight state in the first airflow path 171 is maintained by the sealing member 155. Additionally, the cover unit 170 includes a handle 175 extending from the top thereof, so it is possible for a user to easily separate the cover unit 170 from the body unit 110.

Hereinafter, operations of the cyclone dust-collecting apparatus 100, configured as described above, will be described.

Referring back to FIG. 1, dust-laden air drawn in through the suction port body 13 flows along the cleaner main body 10 and is discharged via the main discharge port 12*a*. The discharged dust-laden air flows into the inlet 112*a* of the body unit 110.

Referring to FIG. 5, the dust-laden air flowing into the cyclone unit 130 via the inlet 112*a* flows towards the dust passage 132*b* through the cylindrical housing 132 while being made to rotate by the rotating guide 135 of the cyclone unit 130. Then, dust is centrifugally separated from the dust-laden air, and the separated dust flows into the dust-collecting chamber 111 through the dust passage 132*b*.

Air from which dust has been separated by the cyclone unit 130 flows into the discharge pipe 133 via the grill member 134, which prevents relatively large dust from flowing into the discharge pipe 133. The air then passes through the discharge pipe 133 and the guide pipe 137 sequentially, and flows into the first airflow path 171 of the cover unit 170. Subsequently, relatively fine dust is separated from the air while the air passes through the filter 157. In this situation, an air current flowing from the guide pipe 137 to the filter 157 is formed substantially in a 'U' shape, so relatively fine dust may settle down on the filter 157 due to the force of gravity.

Air filtered by the filter 157 is discharged from the body unit 110 via the discharge port 112*b* through the second airflow path 132*a*. The discharged air flows into the main inlet 12*b* of the cleaner main body 10, and is then discharged from the cleaner main body 10 via the motor chamber 15.

When a user desires to empty the dust-collecting chamber 111, he or she may detach the cyclone dust-collecting apparatus 100 from the cleaner main body 10 and press the unlocking rod 110*b* to withdraw the hook 113*b* from the locking slit 110*a*, so that the dust door 113 may be made to pivot about the hinge 114 by gravity.

Accordingly, the bottom portion 112 of the body unit 110 may be opened, so it is possible for the user to easily remove dust collected inside the dust door 113 from the dust-collecting chamber 111.

Thereafter, the user can easily separate the cover unit 170 from the body unit 110 using the handle 175, and simply detach the filter body 151 from the body unit 110 by gripping the grip portion 151*c*, in order to maintain and repair the cyclone unit 130 and filter unit 150 of the cyclone dust-collecting apparatus 100.

Additionally, the cyclone dust-collecting apparatus 100 causes in-drawn air to flow through the cyclone unit 130, filter unit 150 and discharge port 112*b* of the body unit 110 which are disposed adjacent to one another, so it is possible to reduce the length of such an airflow path, thereby preventing pressure loss from occurring inside the cyclone dust-collecting apparatus 100.

As described above, according to the exemplary embodiment of the present disclosure, it is possible for a user to easily maintain and repair the cyclone unit and filter unit, as the cyclone unit is exposed to the outside by a simple operation of separating the cover unit from the body and detaching the filter body from the cylindrical body. Additionally, the simple operation of detaching the filter body from the cylindrical body may facilitate maintenance and repair of the filter unit, for example replacement of a filter.

Furthermore, the cyclone dust-collecting apparatus according to the exemplary embodiment of the present disclosure causes in-drawn air to flow through a minimal airflow path from the cyclone unit to the discharge port of the body, which makes it possible to prevent pressure loss from occurring inside the cyclone dust-collecting apparatus.

Although a representative exemplary embodiment of the present disclosure has been illustrated and described in order to exemplify the principle of the present disclosure, the present disclosure is not limited to the specific exemplary embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A cyclone dust-collecting apparatus comprising:

a body unit having a first axis, a top portion of the body unit being detachably engaged with a cover unit;

a cyclone unit disposed inside the body unit so as to rotate dust-laden air about a second axis that is perpendicular to the first axis; and a filter unit detachably disposed above the cyclone unit, wherein air flowing in the body unit is guided from the cyclone unit upward along the first axis to the filter unit, and is discharged downward along the first axis via the filter unit.

2. The cyclone dust-collecting apparatus of claim 1, wherein the cyclone unit is disposed along the second axis, and the dust laden air is drawn into the cyclone unit along the second axis, and air is discharged from the cyclone unit along the first axis.

3. The cyclone dust-collecting apparatus of claim 2, wherein the cyclone unit comprises:

a cylindrical housing in which dust is centrifugally separated from air;

a discharge pipe disposed inside the cylindrical housing and coaxial with the cylindrical housing; and a guide pipe extending from one side of the discharge pipe and penetrating the filter unit, the guide pipe being perpendicular to and in fluid communication with the discharge pipe.

4. The cyclone dust-collecting apparatus of claim 1, wherein the cover unit comprises a handle extending upward therefrom, and is disposed to cover the filter unit.

5. The cyclone dust-collecting apparatus of claim 1, wherein the filter unit comprises:

a filter; and a filter body detachably disposed in an upper portion of the body unit so that the filter is spaced apart by a predetermined distance from an upper portion of the cyclone unit.

6. The cyclone dust-collecting apparatus of claim 5, wherein the filter body comprises a support rib to support the filter so that air passes downward through the filter.

7. The cyclone dust-collecting apparatus of claim 5, wherein the filter body further comprises a protruding portion through which a guide pipe to discharge air from the cyclone unit penetrates, and a grip portion extending upward from the protruding portion to separate the filter body from the body unit.

8. The cyclone dust-collecting apparatus of claim 5, wherein the filter body further comprises a sealing member enclosing an outer circumference of an upper portion of the filter body, to maintain an airtight state between the filter body and the cover unit.

9. The cyclone dust-collecting apparatus of claim 1, wherein the cylindrical housing comprises a dust-collecting chamber disposed below the cyclone unit to collect dust.

10. A cyclone dust-collecting apparatus comprising:

a body unit having a vertical axis, the body unit having an inlet and an outlet defined so that dust-laden air enters and exits the body unit along a horizontal axis that is substantially perpendicular to the vertical axis;

a filter unit detachably secured to the body unit, the filter unit having a top surface along the horizontal axis; and a cyclone unit disposed inside the body unit below the filter unit, the cyclone unit being positioned and configured to rotate the dust-laden air about the horizontal axis, to discharge dust separated from the dust-laden air downward along the vertical axis, and to discharge the rotated and cleaned air upward along the vertical axis to the top surface of the filter unit.

11. The cyclone dust-collecting apparatus of claim 10, wherein the cyclone unit comprises:

a cylindrical housing in which the dust is centrifugally separated from the dust-laden air;

a discharge pipe disposed inside the cylindrical housing and coaxially with the cylindrical housing; and a guide pipe extending from one side of the discharge pipe and penetrating the filter unit, the guide pipe being perpendicular to and in fluid communication with the discharge pipe.

12. The cyclone dust-collecting apparatus of claim 10, further comprising a cover unit disposed to cover the filter unit.

13. The cyclone dust-collecting apparatus of claim 10, wherein the filter unit comprises:

a filter; and a filter body detachably disposed in an upper portion of the body unit so that the filter is spaced apart by a predetermined distance from an upper portion of the cyclone unit.

14. The cyclone dust-collecting apparatus of claim 13, wherein the filter body comprises a support rib to support the filter so that air passes downward through the filter.

15. The cyclone dust-collecting apparatus of claim 13, wherein the filter body further comprises a protruding portion through which a guide pipe to discharge air from the cyclone unit penetrates, and a grip portion extending upward from the protruding portion to separate the filter body from the body unit.

16. The cyclone dust-collecting apparatus of claim 13, wherein the filter body further comprises a sealing member enclosing an outer circumference of an upper portion of the filter body, to maintain an airtight state between the filter body and the cover unit.

17. The cyclone dust-collecting apparatus of claim 10, wherein the cylindrical housing comprises a dust-collecting chamber disposed below the cyclone unit to collect dust.

* * * * *